US010386790B2

(12) United States Patent
Katsuda et al.

(10) Patent No.: US 10,386,790 B2
(45) Date of Patent: Aug. 20, 2019

(54) ELECTRONIC DEVICE

(71) Applicant: CASIO COMPUTER CO., LTD., Shibuya-ku (JP)

(72) Inventors: Hiroshi Katsuda, Kodaira (JP); Akira Suzuki, Fuchu (JP); Akihisa Ohmura, Hachioji (JP); Hiroki Nishiyama, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 65 days.

(21) Appl. No.: 15/805,345

(22) Filed: Nov. 7, 2017

(65) Prior Publication Data

US 2018/0181079 A1 Jun. 28, 2018

(30) Foreign Application Priority Data

Dec. 26, 2016 (JP) ..... 2016-250418

(51) Int. Cl.
*G04B 37/08* (2006.01)
*G04R 60/00* (2013.01)
*G04G 21/04* (2013.01)

(52) U.S. Cl.
CPC ..... *G04B 37/08* (2013.01); *G04G 21/04* (2013.01); *G04R 60/00* (2013.01)

(58) Field of Classification Search
CPC ..... G04B 37/08; G04B 37/081–088; G04B 37/11; G04B 37/116; G04R 60/00–60/14; G04G 17/08; G04G 21/04
See application file for complete search history.

(56) References Cited

U.S. PATENT DOCUMENTS 7,355,556 B2 * 4/2008 Abe ..... H01Q 1/273 343/788
7,639,569 B2 * 12/2009 Yano ..... G04B 37/11 368/281
8,419,269 B2 * 4/2013 Hiranuma ..... G04B 37/08 368/291
8,500,325 B2 * 8/2013 Ueno ..... G04B 37/052 368/287
8,794,824 B2 * 8/2014 Hirayama ..... G04B 37/084 368/294
9,195,221 B2 * 11/2015 Oshita ..... G04R 60/12
(Continued)

FOREIGN PATENT DOCUMENTS

JP 2008-32567 2/2008
JP 2015-81825 4/2015
(Continued)

*Primary Examiner* — Edwin A. Leon
*Assistant Examiner* — Jason M Collins
(74) *Attorney, Agent, or Firm* — Cozen O'Connor

(57) ABSTRACT

An electronic device includes a case with an opening portion; a cover member arranged in the opening portion so as to close the opening portion; a seal member provided between an outer circumferential surface of the cover member and an inner circumferential surface of the opening portion; a reinforcing portion made of a nonconductive material and provided, in the case, on a portion outside the inner circumferential surface in a direction orthogonal to an axial direction of the opening portion; an antenna; and an electronic component arranged in the case and configured to process a radio wave received by the antenna.

14 Claims, 4 Drawing Sheets

(56) References Cited

U.S. PATENT DOCUMENTS

| | | | | |
|---|---|---|---|---|
| 2009/0245032 | A1* | 10/2009 | Bonnet | G04B 37/0008 368/297 |
| 2016/0252887 | A1* | 9/2016 | Namiki | G04G 17/06 368/10 |

FOREIGN PATENT DOCUMENTS

| | | |
|---|---|---|
| JP | 2016-50816 | 4/2016 |
| JP | 2016-181816 | 10/2016 |

* cited by examiner

ELECTRONIC DEVICE

CROSS-REFERENCE TO RELATED APPLICATIONS

This application is based upon and claims the benefit of priority under 35 USC 119 of Japanese Patent Application No. 2016-250418 filed on Dec. 26, 2016, the entire disclosure of which, including the description, claims, drawings, and abstract, is incorporated herein by reference in its entirety.

BACKGROUND OF THE INVENTION

1. Filed of the Invention

The present invention relates to an electronic device including an antenna.

2. Description of the Related Art

As an electronic device that includes an antenna and transmits/receives a radio wave by the antenna, a wristwatch using a GPS (Global Positioning System) is known.

The wristwatch generally includes a cover glass at an end in a case with a closed bottom and is configured to allow a user to visually recognize, via the cover glass, a display device that is internally arranged and displays a time. To increase waterproofness, an annular seal member is provided between the cover glass and the inner surface of the case, as described in Jpn. Pat. Appin. KOKAI Publication No. 2016-50816. When the seal member is fitted in the case by tight fitting, the seal member comes into tight contact with the inner surface of the case, and high waterproofness can be obtained.

In such a wristwatch, the inner surface of the case receives a load that acts outward in the radial direction by the seal member. That is, the case receives a load that expands it outward in the radial direction. If the case receives this load for a long time and becomes deformed, a gap is formed between the seal member and the inner surface of the case, and the waterproofness lowers.

For this reason, there is known a technique of providing an annular reinforcing member made of a metal material on the peripheral portion of the case and improving the strength of the case by the reinforcing member to prevent the deformation of the case. The reinforcing member is made of a metal material and therefore has a high strength.

BRIEF SUMMARY OF THE INVENTION

According to an aspect of embodiments, an electronic device the present invention includes a case with an opening portion; a cover member arranged in the opening portion so as to close the opening portion; a seal member provided between an outer circumferential surface of the cover member and an inner circumferential surface of the opening portion; a reinforcing portion made of a nonconductive material and provided, in the case, on a portion outside the inner circumferential surface in a direction orthogonal to an axial direction of the opening portion; an antenna; and an electronic component arranged in the case and configured to process a radio wave received by the antenna.

According to an aspect of embodiments, an electronic device of an the another invention includes an annular reinforcing member made of a nonconductive material; a tubular case including a large-diameter portion and a small-diameter portion formed to continue to the large-diameter portion, wherein an outer diameter of the small-diameter portion is smaller than an outer diameter of the large-diameter portion and the small-diameter portion is fitted in the reinforcing member; a cover member arranged in the small-diameter portion; an annular seal member provided between an outer circumferential surface of the cover member and an inner circumferential surface of the small-diameter portion; an antenna arranged on an opening end face of the case; and an electronic component arranged in the case and configured to process a radio wave received by the antenna.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained with reference to the drawings.

Figure 1:
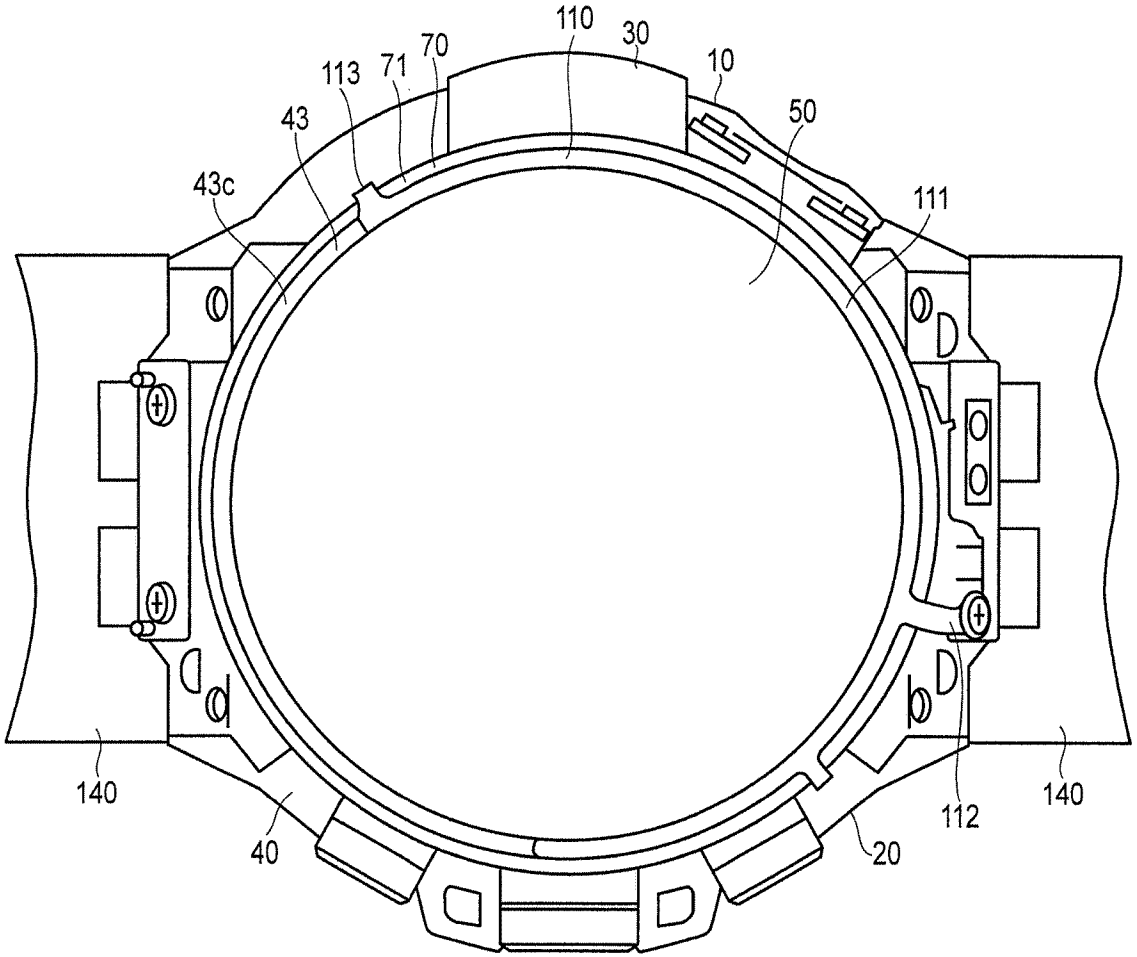
FIG. 1 is a plan view showing the main part of a wristwatch according to an embodiment of the present invention.
Figure 2:
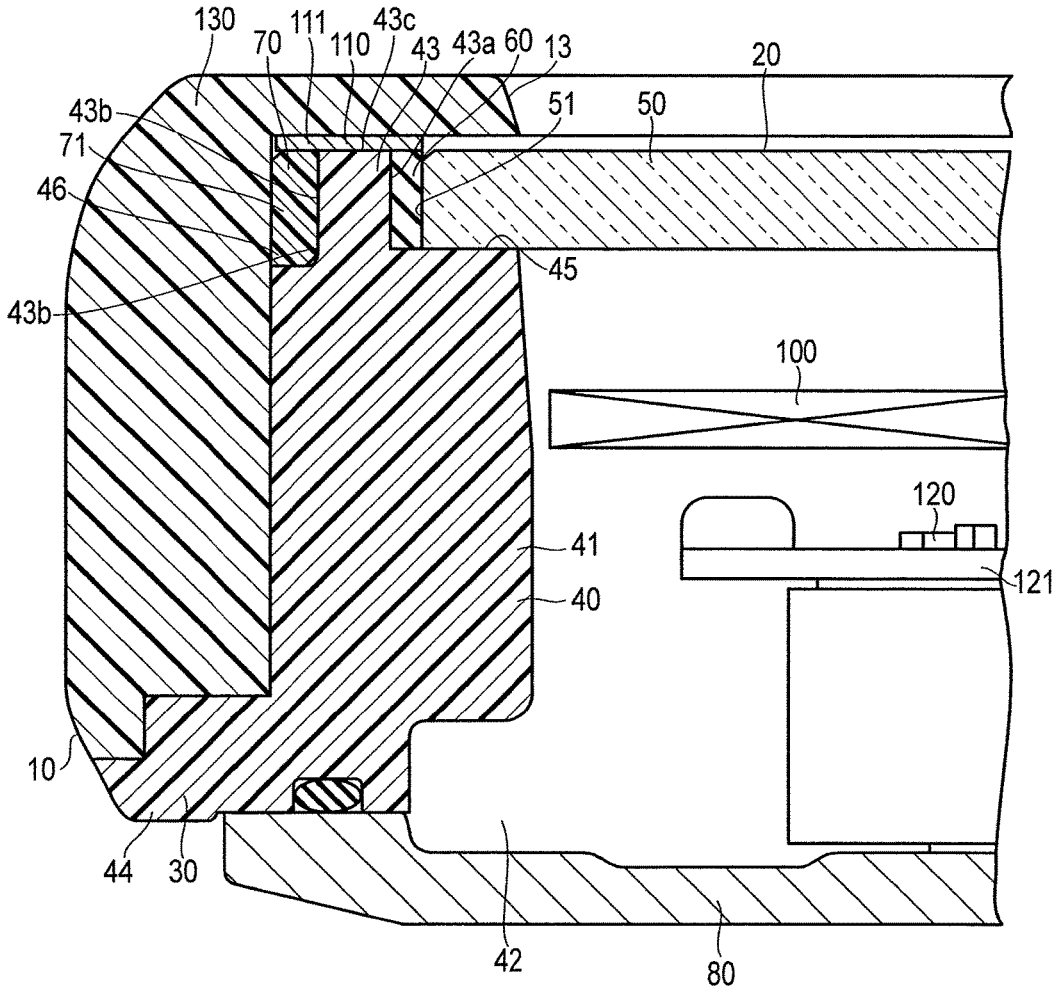
FIG. 2 is a sectional view showing the main part of the wristwatch.

A wristwatch 10 that is an electronic device according to an embodiment of the present invention will be described with reference to FIGS. 1, 2, 3 and 4. FIG. 1 is a plan view showing the main part of the wristwatch 10. FIG. 2 is a sectional view showing the main part of the wristwatch 10. In this embodiment, the wristwatch 10 is configured to be able to acquire the position information of a user using a GPS (Global Positioning System).

As shown in FIG. 1, the wristwatch 10 includes a wristwatch main body 20, and a belt 140 that is wound around a wrist of the user to fix the wristwatch 10 to the user.

As shown in FIG. 2, the wristwatch main body 20 includes a case 30 with a closed bottom, a cover member 50 arranged at the opening end of the case 30, and a seal member 60 provided between the case 30 and the cover member 50. The wristwatch main body 20 further includes a display device 100 stored in the case 30, an antenna 110 provided in the case 30, and an electronic component 120 that is stored in the case 30 and processes a radio wave received by the antenna 110. The wristwatch main body 20 also includes an outer appearance forming member 130 that is provided on the case 30 and forms part of the outer appearance of the wristwatch main body 20.

The case 30 with a closed bottom is an example of a case with an opening portion. The case 30 includes a case member 40 formed into a tubular shape, a reinforcing portion 70 provided at one opening end of the case member 40, and a lid member 80 provided at the other opening end 42 of the case 30. In this embodiment, the upward and downward directions are defined by defining, of the axial direction of the case 30, the direction from the lid member 80 to the cover member 50 as the upward direction. The case member 40 includes a case member main body (large-diameter portion) 41 formed into a tubular shape, and a small-diameter portion 43 arranged above the case member main body 41, formed to continue to the case member main body 41, and including a peripheral surface having a diameter smaller than that of the case member main body 41. The case member main body 41 is formed into a tubular shape.

The small-diameter portion 43 is formed at the upper end of the case member main body 41. The small-diameter portion 43 forms the upper opening end of the case member 40. The small-diameter portion 43 is an example of an opening portion of the case 30. The small-diameter portion 43 is formed into a cylindrical shape. The small-diameter portion 43 is formed to be coaxial or almost coaxial with the case member main body 41. The outer diameter of the small-diameter portion 43 is smaller than the outer diameter of the case member main body 41.

The inner diameter of the small-diameter portion 43 is larger than the inner diameter of the case member main body 41. For this reason, a first end face 45 and a second end face 46 are formed at the boundary between the small-diameter portion 43 and the case member main body 41. The first end face 45 is arranged inside the small-diameter portion 43 and formed into an annular shape. The second end face 46 is arranged outside the small-diameter portion 43 and formed into an annular shape. The second end face 46 is arranged at a position lower than the first end face 45.

The cover member 50 is arranged inside the small-diameter portion 43. That is, the cover member 50 is arranged in the opening defined inside the small-diameter portion 43 so as to close the opening. The cover member 50 is formed into a disc shape having an outer diameter slightly smaller than the inner diameter of the small-diameter portion 43.

The peripheral edge portion of the cover member 50 is placed on the first end face 45. The cover member 50 is made of a transparent material such as glass. The thickness of the cover member 50 is equal to or almost equal to the height from the first end face 45.

The seal member 60 is formed into a tubular shape. The seal member 60 is arranged between an inner circumferential surface 43*a* of the small-diameter portion 43 and an outer circumferential surface 51 of the cover member 50 and formed to liquid-tightly seal between the inner circumferential surface 43*a* and the outer circumferential surface 51. More specifically, the outer diameter of the seal member 60 is set to such a diameter that fits the integral structure of the seal member 60 and the cover member 50 in the small-diameter portion 43 and implements the fitting by tight fitting.

Note that the seal member 60 need not always be fitted in the small-diameter portion 43 by tight fitting. The seal member 60 need only seal between the inner circumferential surface 43*a* of the small-diameter portion 43 and the outer circumferential surface 51 of the cover member 50. Note that if the integral structure of the seal member 60 and the cover member 50 is fitted in the small-diameter portion 43, and the fitting is tight fitting, the waterproofness further improves.

The reinforcing portion 70 is provided on an outer circumferential surface 43*b* of the small-diameter portion 43 and formed into a tubular shape to arrange the inner circumferential surface 43*a* of the small-diameter portion 43 inside. That is, the reinforcing portion 70 is provided, in the case 30, on a portion outside the inner circumferential surface 43*a* of the small-diameter portion 43 in the radial direction that is a direction orthogonal to the axial direction of the small-diameter portion 43.

Note that the axial direction of the small-diameter portion 43 is the same as the axial direction of the case 30. The reinforcing portion 70 is preferably provided within the range including at least the upper end of the small-diameter portion 43. In this embodiment, the reinforcing portion 70 is formed all over in the axial direction of the small-diameter portion 43.

In this embodiment, the reinforcing portion 70 is formed by fixing a ring-shaped reinforcing member 71 to the small-diameter portion 43. The reinforcing member 71 is formed into a ring in which the small-diameter portion 43 can be fitted. By fitting the small-diameter portion 43 inside, the reinforcing member 71 is fixed to the small-diameter portion 43.

The inner diameter of the reinforcing member 71 is equal to or slightly smaller than the outer diameter of the small-diameter portion 43. The fitting of the small-diameter portion 43 in the reinforcing member 71 is, for example, tight fitting. The inner circumferential surface of the reinforcing member 71 is in a surface contact with the outer circumferential surface 43*b* of the small-diameter portion 43.

The height of the reinforcing member 71 is equal to the height of the small-diameter portion 43 from the second end face 46. The upper end face of the reinforcing member 71 is flush with the upper end face 43*c* of the small-diameter portion 43. The thickness of the reinforcing member 71 is equal to or almost equal to the width of the second end face 46 in the radial direction.

The reinforcing member 71 is made of a nonconductive material. The reinforcing member 71 has a strength capable of preventing the small-diameter portion 43 from expanding outward in the radial direction. The strength of the reinforcing member 71 will be described in detail.

In this embodiment, the integral structure of the seal member 60 and the cover member 50 is fitted in the small-diameter portion 43, and the fitting is tight fitting. For this reason, a load is input from the seal member 60 to the inner circumferential surface 43*a* of the small-diameter portion 43 outward in the radial direction. This is because the integral structure of the seal member 60 and the cover member 50 is fitted in the small-diameter portion 43 by tight fitting.

The reinforcing member 71 has a strength capable of preventing the small-diameter portion 43 from becoming deformed upon receiving the load. The reinforcing member 71 is made of, for example, a nonconductive resin material and a material containing a glass fiber arranged in the resin material. Since the glass fiber extends in the circumferential direction of the reinforcing member 71, the strength in the radial direction increases, and the reinforcing member 71 hardly expands in the radial direction.

Note that the reinforcing member 71 need not always be made of the above-described material. As another example, the reinforcing member 71 may contain a super fiber such as an aramid fiber or polyethylene fiber. That is, any fiber having a necessary strength is usable. If a fiber is contained, the fiber is arranged such that its longitudinal direction becomes parallel to the circumferential direction of the reinforcing member.

The lid member 80 is formed into a disc shape and fixed to the other opening end 42 of the case member main body 41. The lid member 80 closes the opening end face at the other end of the case member 40. The outer appearance forming member 130 is formed into a cup shape with an opening 131. The outer appearance forming member 130 covers the antenna 110. The outer appearance forming member 130 is made of a nonconductive material such as a resin.

Note that the outer appearance forming member 130 is not illustrated in FIG. 1. The display device 100 is configured to be able to display a time and the position information of the wristwatch 10. The display device 100 includes a display unit 101 such as a liquid crystal display and a control unit that controls the display unit.

The antenna 110 is formed to be able to receive a radio wave emitted by an artificial satellite. The antenna 110 is made of, for example, a metal material. As shown in FIG. 1, the antenna 110 includes an antenna main body 111 placed on the upper end face 43*c* of the small-diameter portion 43, and a connected portion 113 electrically connected to the electronic component 120.

The antenna main body 111 is formed into a C shape along the upper end face 43*c* of the small-diameter portion 43 in a planar view. The antenna main body 111 is formed into a thin plate shape. The antenna main body 111 includes a fixing portion 112 that fixes the antenna main body 111 to the case 30. The connected portion 113 is formed to continue to the antenna main body 111. The connected portion 113 is formed to be able to transmit the radio wave received by the antenna 110 to the electronic component 120.

The electronic component 120 is directly or indirectly connected to the connected portion 113. The electronic component 120 is formed to be able to detect the position of the wristwatch 10 based on the radio wave received by the antenna 110 and display the detected position information on the display device 100. The position detection and the display are examples of processing of the radio wave received by the antenna 110. For example, the electronic component 120 is mounted on a substrate 121 arranged in the case 30.

Note that the substrate 121 may have other electronic components mounted thereon and form the control unit of the above-described display device 100 together with the electronic components.

In the wristwatch 10 configured in this way, the reinforcing portion 70 can prevent a gap from being formed between the seal member 60 and the inner circumferential surface 43*a*. It is therefore possible to prevent lowering of the waterproofness of the wristwatch 10. In addition, the reinforcing portion 70 is made of a nonconductive material. Hence, since the radio wave from the artificial satellite can be prevented from being blocked by the reinforcing portion 70, lowering of the radio wave reception performance of the antenna 110 can be prevented.

The reinforcing portion 70 can easily be formed because it can be formed only by fitting the small-diameter portion 43 inside in the radial direction of the reinforcing member 71. The reinforcing member 71 is made of a resin and a glass fiber and can therefore have a high strength relatively easily.

When the reinforcing member 71 is flush with the upper end face 43*c* of the small-diameter portion 43, the upper end of the small-diameter portion 43 is supported by the reinforcing portion 70. This can more effectively prevent the small-diameter portion 43 from expanding outward in the radial direction.

Since the antenna main body 111 is arranged on the upper end face 43*c* of the small-diameter portion 43, the wristwatch 10 can be made compact. This effect will be described in detail. In a case in which the antenna 110 is arranged in the case 30, to prevent the reception performance of the antenna 110 from lowering due to the conductive material arranged in the case 30, it is necessary to make the case 30 large and increase the distance between the antenna 110 and the conductive material in the case 30.

However, in the wristwatch 10, when the antenna main body 111 is arranged on the upper end face 43*c* of the small-diameter portion 43, most part of the antenna 110 can be arranged outside the case 30. Hence, the case 30 can be prevented from becoming bulky. In addition, when the upper end face 43*c* of the small-diameter portion 43, which is originally a dead space, is used, the space to place the antenna main body 111 need not be formed anew.

Figure 3:
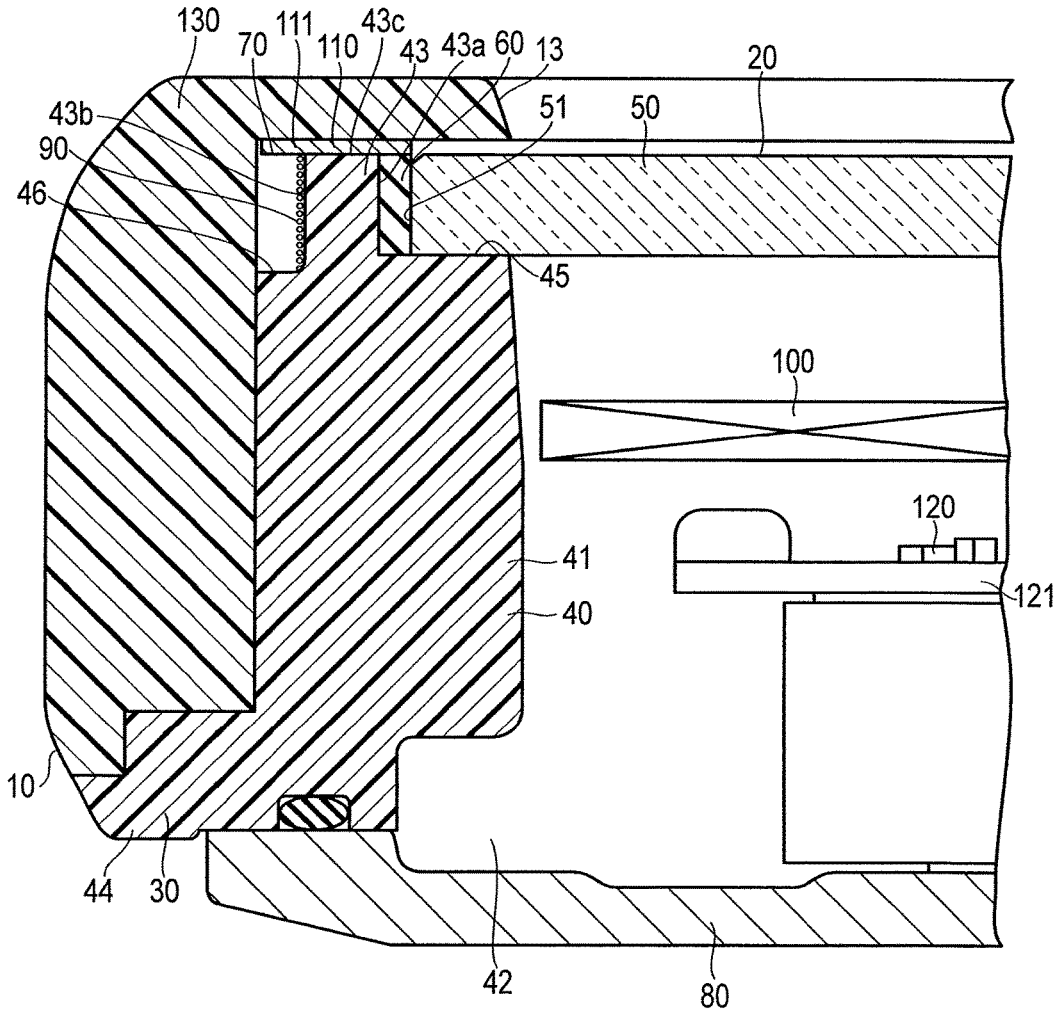
FIG. 3 is a sectional view showing a modification of the wristwatch.

Note that in this embodiment, the reinforcing portion 70 is formed by assembling the reinforcing member 71 to the small-diameter portion 43. However, the present invention is not limited to this. As another example, as shown in FIG. 3, the reinforcing portion 70 may be formed integrally with the outer circumferential surface 43*b* of the small-diameter portion 43.

In this example, the reinforcing portion 70 may be formed by winding a fiber 90 made of a nonconductive material such as a glass fiber around the outer circumferential surface 43*b* of the small-diameter portion 43 in the circumferential direction. Forming the reinforcing portion 70 integrally with the case member 40 by fixing the material to form the reinforcing portion 70 to the outer circumferential surface of the opening portion of the case member 40 is effective when the opening portion has a shape other than a cylindrical shape. That is, this is because it is difficult to fit the opening portion in the reinforcing member having the same shape as the opening portion when the planar shape of the opening end of the case member 40 is polygonal.

Alternatively, the reinforcing portion 70 need not always be fixed to the outer circumferential surface of the opening portion of the case member 40. For example, the reinforcing portion 70 may be integrally formed by insert molding in the thickness of the opening portion of the case member 40.

A wristwatch 10A according to a modification will be described with reference to FIG. 4. The wristwatch 10A includes a case member 40A in place of the case member 40, and a reinforcing portion 70A in place of the reinforcing portion 70. The remaining components are the same as in the wristwatch 10. Note that components other than the case member 40A, the cover member 50, the seal member 60, the reinforcing portion 70A, and the antenna 110 are not illustrated in FIG. 4.

Figure 4:
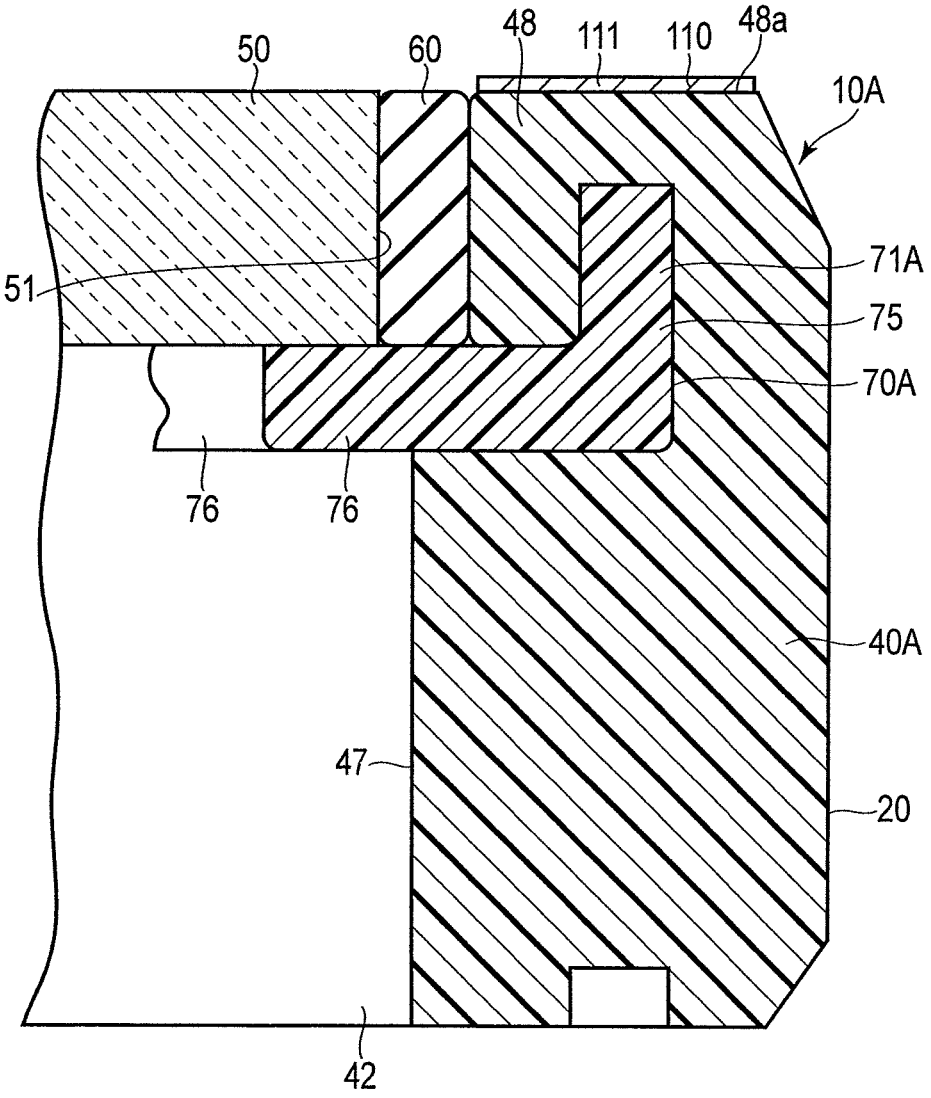
FIG. 4 is a sectional view showing a modification of the wristwatch.

As shown in FIG. 4, the case member 40A is formed into a tubular shape. The antenna main body 111 of the antenna 110 is arranged on an upper end face 48*a* of an opening end 48 that is the upper end of the case member 40A. The reinforcing portion 70A is formed by arranging a reinforcing member 71A near the seal member 60 at the opening end 48 of the case member 40A.

The reinforcing member 71A has a strength capable of preventing the opening end 48 from being deformed outward in the radial direction. The reinforcing member 71A is made of a nonconductive material such as a resin. At least part of the reinforcing member 71A is arranged outside in the radial direction of the seal member 60 with respect to the seal member 60.

The reinforcing member 71A includes a reinforcing member main body 75 formed into a tubular shape and having an inner circumferential surface 47 of the opening end 48 arranged inside, and an annular edge portion 76 formed on the reinforcing member main body 75 and extending inward in the radial direction. The reinforcing member main body 75 is arranged outside the seal member 60 in the radial direction from the lower end of the seal member 60 up to a halfway point.

A part of the edge portion 76 projects from the inner circumferential surface 47 of the case member 40A. The cover member 50 and the seal member 60 are placed on the portion of the edge portion 76 projecting from the inner circumferential surface 47. The structure with the reinforcing portion 70A formed in the thickness of the opening end 48 in this way is effective when the opening end 48 has a shape other than a cylindrical shape.

Note that in this embodiment, each of the wristwatches 10 and 10A includes the outer appearance forming member 130. However, the present invention is not limited to this. For example, each of the wristwatches 10 and 10A may have a structure without the outer appearance forming member 130. Alternatively, the outer appearance forming member may be formed integrally with the case 30. In this embodiment, the case member 40 and the lid member 80 are separately formed. However, the present invention is not limited to this. For example, the case member 40 and the lid member 80 may be integrally formed.

The antenna 110 is provided on the upper end face 43*c* of the small-diameter portion 43 of the case member 40. However, the present invention is not limited to this. The antenna 110 may be stored in, for example, the case 30. Note that in this embodiment, each of the wristwatches 10 and 10A is used as an example of the electronic device according to the present invention. However, the present invention is not limited to this. The electronic device according to the present invention may be a device other than the wristwatches 10 and 10A. The electronic device may be, for example, a GPS pod, a smart watch, or a portable telephone. That is, the present invention is applicable to any device including an antenna and an electronic component that processes a radio wave received by the antenna.

Additionally, in this embodiment, the reinforcing member 71 is made of a resin and a glass fiber. However, the present invention is not limited to this. The material to form the reinforcing member 71 need only have a nonconductive characteristic. As another example, the reinforcing member 71 may be made of only a resin.

Note that the tubular shape in the present invention and the embodiment is not limited to a cylinder, and also includes a tubular shape other than a cylinder, such as a tubular shape that is rectangular in a planar view. Similarly, the annular shape in the present invention is not limited to a ring, and also includes a shape other than a ring, such as an annular shape that is rectangular in a planar view.

In this embodiment, the small-diameter portion 43 is formed into a cylinder as an example. However, the present invention is not limited to this. For example, the small-diameter portion 43 may be formed into a tubular shape other than a cylinder, such as a tubular shape that is rectangular in a planar view. Additionally, in this embodiment, the seal member 60 is formed into an annular shape as an example. However, the present invention is not limited to this. The seal member 60 is formed in conformity with the shape of the cover member 50.

For example, if the cover member 50 has a rectangular shape in a planar view, the seal member 60 may be formed into an annular shape that is rectangular in a planar view. The seal member 60 may have a shape other than an annular shape. The seal member 60 may be partially formed in the circumferential direction between the inner circumferential surface of the opening portion of the case and the outer circumferential surface of the cover member.

In this embodiment, the reinforcing member 71 is formed into a ring as an example. However, the present invention is not limited to this. The reinforcing member 71 may be formed into an annular shape other than a ring, such as an annular shape that is rectangular in a planar view. For example, if the small-diameter portion 43 is formed into a tubular shape that is rectangular in a planar view, the reinforcing member 71 is formed into a tubular shape that is rectangular in a planar view in conformity with the small-diameter portion 43.

Each of the reinforcing portions 70 and 70A and the reinforcing members 71 and 71A is formed into an annular shape. However, the present invention is not limited to this. Each of the reinforcing portions 70 and 70A and the reinforcing members 71 and 71A may be formed into a C shape in a planar view. That is, each of the reinforcing portions 70 and 70A and the reinforcing members 71 and 71A need only be formed to be able to give a strength capable of preventing lowering of waterproofness caused by the outward deformation of the opening portion of the case.

In this embodiment, as shown in FIGS. 2, 3 and 4, each of the reinforcing portions 70 and 70A is arranged at a position where at least part of the reinforcing portion is arranged outside the seal member 60 in a direction orthogonal to the axial direction of the small-diameter portion 43 or the opening end 48 as the opening portion. Even in a case in which the reinforcing portion is formed by directly fixing a fiber or the like as the material to form the reinforcing portion to the outer circumferential surface of the opening portion at least part of the reinforcing portion is preferably arranged outside the seal member 60 in a direction orthogonal to the axial direction of the opening portion. When the reinforcing portion is arranged at a position where at least part of the reinforcing portion is arranged with respect to the seal member in a direction orthogonal to the axial direction of the opening portion, the strength of a portion of the opening portion, which receives a force from the seal member, can easily be improved.

Note that the present invention is not limited to the above-described embodiment, and various modifications can be made upon implementation without departing from the scope of the invention. Additionally, the embodiments may appropriately be combined as much as possible, and in this case, a combined effect can be obtained. The embodiments incorporate inventions of various stages, and various inventions can be extracted by appropriately combining a plurality of constituent elements disclosed in the embodiments. For example, even if some of the constituent elements disclosed in the embodiments are deleted, an arrangement in which the constituent elements are deleted can be extracted as an invention as long as the problem described in the section of the problem to be solved by the invention can be solved, and the effects described in the section of the effects of the invention can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electronic device comprising:

a case with an opening portion;

a cover member arranged in the opening portion so as to close the opening portion;

a seal member provided between an outer circumferential surface of the cover member and an inner circumferential surface of the opening portion;

a reinforcing portion made of a nonconductive material and provided, in the case, on a portion outside the inner circumferential surface in a direction orthogonal to an axial direction of the opening portion;

an antenna; and an electronic component arranged in the case and configured to process a radio wave received by the antenna.

2. The device of claim 1, wherein the reinforcing portion is formed into an annular shape with the inner circumferential surface of the opening portion arranged inside.

3. The device of claim 1, wherein the seal member is formed into an annular shape.

4. The device of claim 1, wherein the reinforcing portion comprises an annular reinforcing member fitted on an outer circumferential surface of the opening portion.

5. The device of claim 1, wherein the reinforcing portion is formed integrally with the outer circumferential surface of the opening portion.

6. The device of claim 1, wherein the antenna is arranged on an opening end face of the case.

7. The device of claim 1, wherein the nonconductive material comprises a resin.

8. The device of claim 1, wherein the nonconductive material comprises a glass fiber.

9. The device of claim 1, wherein the antenna receives a GPS signal.

10. An electronic device comprising:

an annular reinforcing member made of a nonconductive material;

a tubular case including a large-diameter portion and a small-diameter portion formed to continue to the large-diameter portion, wherein an outer diameter of the small-diameter portion is smaller than an outer diameter of the large-diameter portion and the small-diameter portion is fitted in the reinforcing member;

a cover member arranged in the small-diameter portion;

an annular seal member provided between an outer circumferential surface of the cover member and an inner circumferential surface of the small-diameter portion;

an antenna arranged on an opening end face of the case; and an electronic component arranged in the case and configured to process a radio wave received by the antenna.

11. The device of claim 10, wherein the reinforcing member is formed integrally with an outer circumferential surface of the large-diameter portion.

12. The device of claim 10, wherein the nonconductive material comprises a resin.

13. The device of claim 10, wherein the nonconductive material comprises a glass fiber.

14. The device of claim 10, wherein the antenna receives a GPS signal.

* * * * *